United States Patent [19]

Simmons

[11] 3,941,275

[45] Mar. 2, 1976

[54] SEALED CLOSURE SYSTEM FOR CONTAINERS

[75] Inventor: Richard J. Simmons, Carol Stream, Ill.

[73] Assignee: Plastofilm Industries, Inc., Wheaton, Ill.

[22] Filed: Jan. 20, 1975

[21] Appl. No.: 542,504

[52] U.S. Cl. ..... 220/256; 220/23; 220/306; 220/352; 220/366; 220/307

[51] Int. Cl.[2] ..... B65D 51/18

[58] Field of Search ..... 220/256, 306, 23, 307, 220/352, 353, 366

[56] References Cited

UNITED STATES PATENTS

| | | | |
|---|---|---|---|
| 2,528,948 | 11/1950 | Cosmo | 220/352 |
| 3,167,079 | 1/1965 | Weil | 220/23 |
| 3,381,872 | 5/1968 | Holder et al. | 220/366 |
| 3,482,729 | 12/1969 | Penton | 220/23 |

*Primary Examiner*—George T. Hall
*Attorney, Agent, or Firm*—Darbo, Robertson & Vandenburgh

[57] ABSTRACT

Containers of the open top can type are closed and sealed by a closure system comprising an inner lid of thin material such as plastic film and a stiff outer cover which grips the container and bears down on the inner lid flange to hold it securely in closed, sealing position. Optional provision is made for the escape of air during insertion of the inner lid and retention of the lid in position pending application of the outer cover.

12 Claims, 12 Drawing Figures

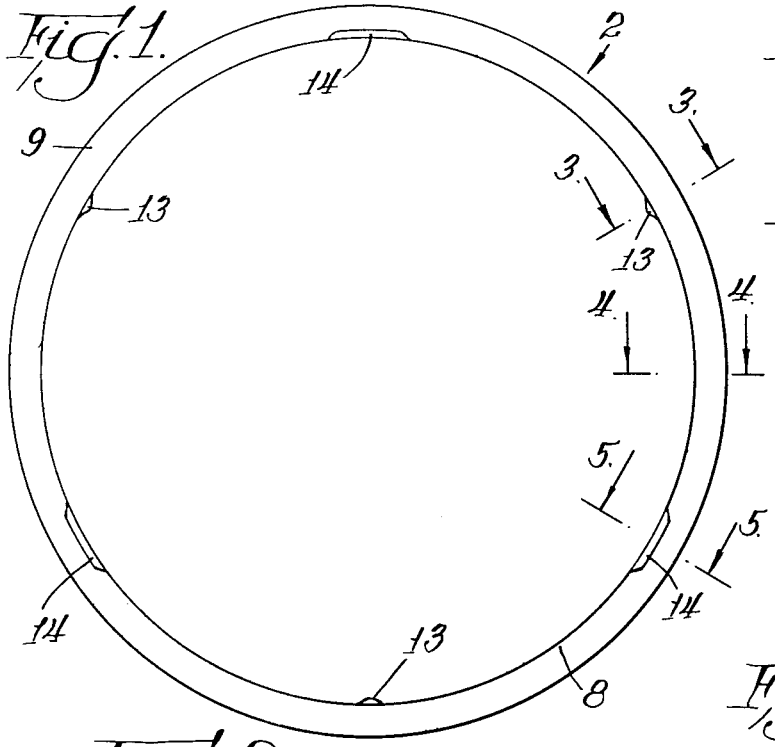
Fig. 1.
2
3
3
9
13
13
14
4
4
5
5
14
14
13
8
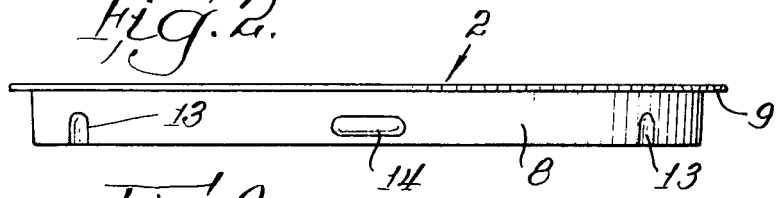
Fig. 2.
2
13
9
14
8
13
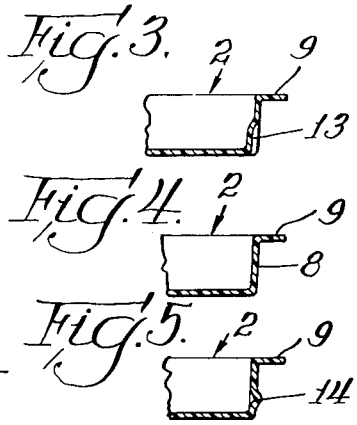
Fig. 3.
2
9
13
Fig. 4.
2
9
8
Fig. 5.
2
9
14
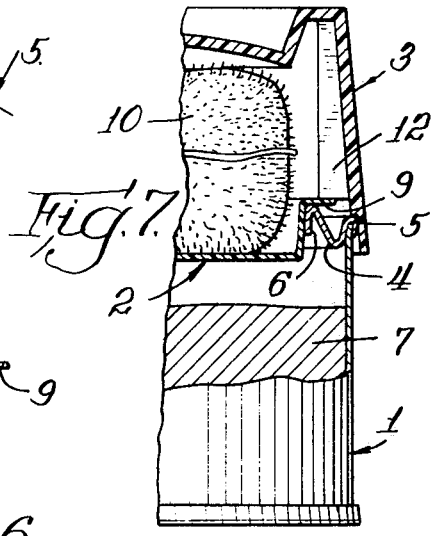
Fig. 7.
3
10
12
9
5
2
6
4
7
1
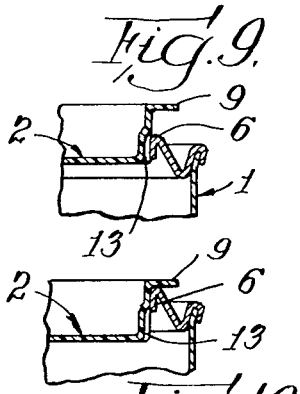
Fig. 9.
9
2
6
1
13
9
2
6
13
Fig. 10.
Fig. 11
9
8
14
6
4
1
Fig. 12
9
6
2
14
1
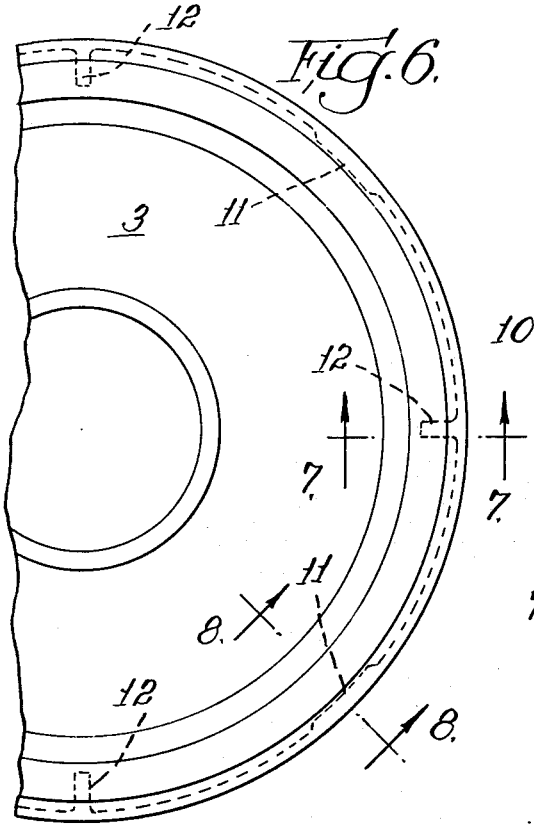
Fig. 6.
12
3
11
12
7
7
11
8
12
8
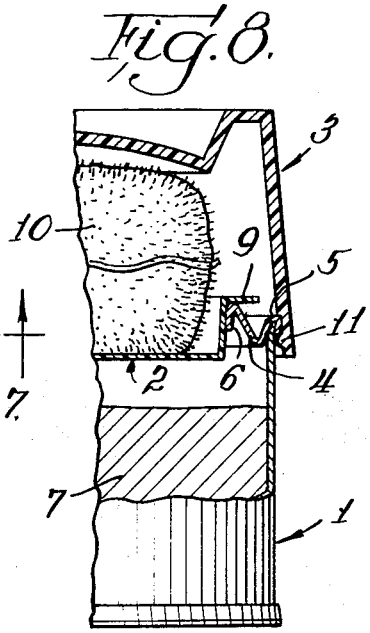
Fig. 8.
3
10
9
5
11
2
6
4
7
1

SEALED CLOSURE SYSTEM FOR CONTAINERS

BACKGROUND AND SUMMARY OF THE INVENTION

Closures for containers in which materials are packaged for shipment, sale and storage pending use must dependably retain the material within the container and, especially if the material includes volatile constituents, must seal the container against the escape of gases or vapors. Lids of the type that are forced down into the circular openings at the tops of cans are commonly fabricated from thin steel strip and are strong enough to frictionally engage the container at the opening with sufficient pressure to ensure against unintended lifting of the lid resulting from internal pressure or other forces applied to the inner surfaces of the lids. These metal lids are relatively expensive.

For special purposes, such as the packaging of a material and an applicator in a single package unit, space is provided for the applicator in and above an inner lid which closes the can containing the material and an outer cover is provided to enclose the applicator. In the case, for example, of a package for a semisolid car wax, the wax material is contained within a can having a large mouth at its top and this can is closed and sealed by a lid that is pressed tightly down into the mouth of the can. A wax applicator is seated within this inner lid and is, in turn, held in the container unit by a stiff outer cover which snaps over the top bead of the can but does not necessarily provide a seal closure. The physical characteristics of the semisolid wax material are such that the tipping and jarring of a can, as in shipment, may cause the body of material to flow sufficiently to bear against the lid with the possible consequence of pushing it out sufficiently to permit leakage unless the lid is strong enough and is forced into the mouth of the can with enough force to have securely locked it in position.

The necessity of the outer cover of such duplex packages offers the possibility of relaxing the demands upon the inner lid in serving its closing and sealing function. In accordance with the present invention, the inner lid is made of relatively inexpensive, thin plastic material which, while capable of closing and sealing container cans of the type above referred to, is not strong enough to engage the can at its mouth with sufficient sustained pressure to hold itself tightly in place pending intentional forced removal. Instead of depending upon its own strength for this purpose, as in the case of lids made of steel, stops are provided around the inner periphery of the outer stiff cover to bear upon the flange of the inner lid at spaced locations throughout its periphery as the cover is snapped into position upon the can.

Accordingly, the principal object of the invention is to provide a duplex package which employs an inner lid of thin plastic material to close and seal the base can and an outer cover which holds the inner lid in its sealing position. This object is realized by providing the outer cover with detent means which engage the top bead of the can to hold the cover firmly down upon the can and spaced stops within the cover which bear against the flange of the inner lid when the outer cover has been snapped down into position.

A further object is to provide means for the escape of air as the lids are forced down into the mouths of the cans in the high-speed assembly line. Another object is to provide detent means on the riser portions of the inner lids which serve to hold the lids in position in the openings of the cans pending application of the outer covers.

DESCRIPTION OF THE DRAWING

In the accompanying drawing:

FIG. 1 is a bottom view of the inner lid of the duplex package;

FIG. 2 is a side view of the lid;

FIGS. 3, 4 and 5 are detail views, in cross section, taken at the lines 3—3, 4—4, and 5—5, respectively;

FIG. 6 is a plan view, partly broken away, of the duplex package;

FIG. 7 is a detail view in cross section taken at the line 7—7 of FIG. 6;

FIG. 8 is a detail view, in cross section, taken at the line 8—8 of FIG. 6;

FIG. 9 is a detail view, in cross section, showing the lid air vent with the lid only partly inserted into the mouth of the can;

FIG. 10 is a view similar to that of FIG. 9 but with the lid in closed, sealing position;

FIG. 11 is a detail view, in cross section, showing the lid detent with the lid just entered into the mouth of the can, and FIG. 12 is a view similar to that of FIG. 11 with the lid in closed position with the detent engaging the can at the opening.

DESCRIPTION OF SPECIFIC EMBODIMENT

Although the closure system of the invention is suitable for use in packaging solid, semisolid and powder materials, its greatest advantages are manifested in the packaging of a flowable material such as a pre-whipped car wax mixture which, in the normal upright position of the can container, appears to be a soft solid but which, when tipped or jarred with a sidewise component of force, will flow and may then engage and press on the lid, tending to loosen it. Accordingly, by way of a specific example of one of many useful embodiments of the invention, a duplex package containing such wax material and an applicator is shown in the drawing and will be described herein.

The package assembly, as shown in FIGS. 6, 7 and 8, comprises a can 1, an inner lid 2 and an outer cover 3. The can is of conventional wide mouth form and construction, including a flange 4 which is secured to the top of the can by upper bead 5 and has a relatively narrow depending flange 6 which defines the mouth of the can. As shown, the can is filled, in the commercial sense, with the wax material 7.

Lid 2 (FIGS. 1 and 2) has a riser 8 and peripheral flange 9 in addition to the planar central portion as is conventional. The lid is advantageously thermo-formed from a suitable plastic material, such as 0.015 inch polyvinyl chloride film. Preferably, the lid is formed with a very small riser draft of, say, two degrees. The lid should be strong and stiff enough and dimensioned to continuously exert sealing pressure at the engaging surfaces of flange 2 and riser 8 when seated in the mouth of the can in fully closed position as shown in FIGS. 7 and 8.

In the particular embodiment of the invention illustrated in the drawing and specifically described herein, outer cover 3 is injection molded of a suitable plastic material which will provide a relatively rigid structure. It is designed to provide an enclosure above inner lid 2 to accommodate a wax applicator 10. At spaced locations throughout the periphery of the open bottom of the cover, spaced detent beads 11 are provided to serve as latch means engaging the underside of upper bead 5 of the can to hold the cover securely down upon the can as shown in FIG. 8. Spaced vertical ribs 12 (FIGS. 6 and 7), molded with the cover, extend radially inwardly from the side of cover 3. Ribs 12 are dimensioned to extend inwardly and downwardly sufficiently to engage the flange 9 of inner lid 2, as shown in FIG. 7, when the cover has been snapped down over upper bead 5 of the can as shown in FIG. 8. With this arrangement and construction of parts, outer cover 3 serves to positively hold inner lid 2 in its fully closed and sealing position in the mouth of the can.

As shown in FIG. 7, the bottom edges of ribs 12 engage the flange of lid 2 outwardly of the can mouth flange 6. This provides a degree of tolerance since the flange may bend slightly as the pressure of the rib is brought to bear when the cover is snapped onto the can. The rib may, however, extend inwardly sufficiently to engage the flange 9 of lid 2 directly above the can flange 6 since some tolerance is available, anyway, at the latching junctures of detent beads 11 and upper can bead 5.

Although four detent beads 11 and four vertical ribs 12 are provided in the example illustrated in the drawing, the number will depend upon the size of the can and other considerations. Usually three or more of each of these elements would be provided.

Although not essential for the operation of the closure system of the invention, air escape grooves 13 and what might be termed temporary detents are formed in the risers 8 of inner lids 2. In high speed machine filling and assembly of the duplex package, insertion of the lids into the mouths of the cans is facilitated by providing for the escape of air that is displaced by the lids. Grooves 13 extend about half-way up on the lid risers so that escape passageways are provided, as is shown in FIG. 9, until the sealing upper peripheries of the lid risers engage flanges 6 of the can to effect the desired seal when the lid is in fully closed position as shown in FIG. 10. The purpose of detents 14 is to hold the lids in position in the mouths of the cans pending the placing of the applicators 10 upon the lids and the locking of the outer covers 3 upon the cans. As is shown in FIG. 11, the detents 14 do not interfere with the alignment of the lids with the mouths of the cans since the detents are spaced upwardly from the bottoms of the lids. As is shown in FIG. 12, the detents engage the under edges of flanges 6 of the cans to hold the lids in position pending final assembly of the package.

ACHIEVEMENT

When the assembly of the package has been completed by forcing the cover 3 into latched-on position on top of the can, the inner lid 2 can be lifted away from flange 4 in the mouth of the can only after first removing the cover. The cover 3 is made with sufficient strength and stiffness to require the application of substantial force to remove it. Thus, the can remains securely closed and sealed even in the event of the application of substantial forces applied internally against the bottom of the lid and tending to lift it from its seated position, as by the flow of material contained in the can against the lid when the package is tilted or laid on its side or jarred in such a way as to bring about contact with the lid. Yet, the lid may be easily lifted and removed after removal of the outer cover.

The sealed closure system of the invention makes possible the use of thin plastic material for the inner lids rather than steel or other metal as heretofore. The cost of the plastic lids is only a fraction of that of metal lids. Additionally, the plastic lids are more easily removed for access to the contents of the can and may, if desired, be transparent so that the contents may be viewed through the lid.

The combination of air vents and detents on the risers of the inner lids prevents the floating off of lids rapidly inserted into the mouths of the cans in the filling and assembly machines. Instead of capturing the cushion of air in the space above the material in the can, sufficient air is permitted to escape to enable the detents to hold the lids in place until assembly is completed. This expedient avoids problems and reduces the number of imperfect packages delivered from the machines.

I claim:

1. In a sealed closure system for containers which comprise a large-mouth material container can, a flanged inner lid sealingly closing the can, and an outer cover removably latched by means of detent beads onto the top of the can enclosing the inner lid, the improvement wherein the inner lid is made of thin plastic and the outer cover is provided with stop means engaging the flange of said lid to hold the same securely in fully closed and sealing position upon the can, the mouth of the can being defined by a circular flange affixed to the can and the flange of the lid extending outwardly beyond said circular flange whereby the outer periphery of the lid flange is free for some downward movement, said stop means engaging only the outer periphery of said lid flange.

2. Structure in accordance with claim 1 wherein the mouth of the can is defined by a circular flange affixed to the can and the flange of the lid extends outwardly beyond said circular flange whereby the outer periphery of the lid flange is free for some downward movement and the stop means engages only the outer periphery of said lid flange.

3. Structure in accordance with claim 1 wherein the stop means comprises a plurality of spaced elements projecting inwardly from the side of the outer cover.

4. Structure in accordance with claim 3 wherein the spaced elements are radial ribs integral with the outer cover.

5. In a sealed closure system for containers which comprise a large-mouth material container can, a flanged inner lid sealingly closing the can, and an outer cover removably latched onto the top of the can enclosing the inner lid, the improvement wherein the inner lid is made of thin plastic and the outer cover is provided with stop means engaging the flange of said lid to hold the same securely in fully closed and sealing position upon the can, said inner lid including a riser and air vent grooves provided at spaced points around said riser, said grooves extending from the bottom of said riser toward but stopping short of the top thereof whereby to maintain a complete circular sealing surface along the top of said riser.

6. In a sealed closure system for containers which comprise a large-mouth material container can, a flanged inner lid sealingly closing the can, and an outer cover removably latched onto the top of the can enclosing the inner lid, the improvement wherein the inner lid is made of thin plastic and the outer cover is provided with stop means engaging the flange of said lid to hold the same securely in fully closed and sealing position upon the can. said inner lid including a riser and spaced detents provided at spaced points around said riser to hold said lid in position in the mouth of the can, said detents being spaced below the top of said riser whereby to maintain a complete circular sealing surface along the top of said riser.

7. Structure in accordance with claim 6 wherein the detents are spaced above the bottom of the riser whereby to maintain a complete circular surface along the bottom of the riser for unobstructed initial entry of the lid into the mouth of the can.

8. Structure in accordance with claim 6 and including air vent grooves at spaced points around the riser, said grooves extending from the bottom of said riser toward but stopping short of the top thereof whereby to maintain a complete circular sealing surface along the top of said riser.

9. Structure in accordance with claim 8 wherein the detents are spaced above the bottom of the riser whereby to maintain a complete circular surface along the bottom of the riser for unobstructed initial entry of the lid into the mouth of the can.

10. In a lid for closing and sealing a large-mouth material container can, said lid having a riser extending upwardly from the bottom of the lid to the flange thereof, the improvement wherein the lid is made of thin plastic and the riser is provided with air vent grooves at spaced points around said riser, said grooves extending from the bottom of said riser toward but stopping short of the top thereof whereby to maintain a complete circular sealing surface along the top of said riser.

11. In a lid for closing and sealing a large-mouth material container can, said lid having a riser extending upwardly from the bottom of the lid to the flange thereof, the improvement wherein the lid is made of thin plastic and the riser is provided with detents at spaced points around said riser to hold said lid in position in the mouth of the can, said detents being spaced below the top and above the bottom of said riser whereby to maintain a complete circular sealing surface along the top of said riser and a complete circular entry alignment surface at the bottom of said riser.

12. Structure in accordance with claim 11 wherein the riser is provided with air vent grooves at spaced points around said riser, said grooves extending from the bottom of said riser toward but stopping short of the top thereof whereby to maintain a complete circular sealing surface along the top of said riser.

* * * * *

UNITED STATES PATENT OFFICE

CERTIFICATE OF CORRECTION

Patent No. 3,941,275 Dated March 2, 1976

Inventor(s) Richard J. Simmons

It is certified that error appears in the above-identified patent and that said Letters Patent are hereby corrected as shown below:

Delete claims 2 and 10

Signed and Sealed this

Thirteenth Day of July 1976

[SEAL]

*Attest:*

RUTH C. MASON
*Attesting Officer*

C. MARSHALL DANN
*Commissioner of Patents and Trademarks*